US007267525B2

(12) United States Patent
Hiegemann et al.

(10) Patent No.: US 7,267,525 B2
(45) Date of Patent: Sep. 11, 2007

(54) ROTOR FOR A STEAM TURBINE

(75) Inventors: Michael Hiegemann, Gebenstorf (CH); Martin Reigl, Unterehrendingen (CH)

(73) Assignee: AlstomTechnology Ltd., Baden (CH)

( * ) Notice: Subject to any disclaimer, the term of this patent is extended or adjusted under 35 U.S.C. 154(b) by 85 days.

(21) Appl. No.: 10/998,383

(22) Filed: Nov. 29, 2004

(65) Prior Publication Data

US 2005/0118025 A1 Jun. 2, 2005

(30) Foreign Application Priority Data

Nov. 28, 2003 (DE) ..... 103 55 738

(51) Int. Cl.
*F01D 5/14* (2006.01)

(52) U.S. Cl. ..... 415/115; 416/91

(58) Field of Classification Search ..... 415/115, 415/116; 416/90 R, 91, 92, 93 R, 96 R, 416/97 R See application file for complete search history.

(56) References Cited

U.S. PATENT DOCUMENTS 5,639,209 A 6/1997 Pollini et al. ..... 415/116
5,993,154 A * 11/1999 Endres et al. ..... 416/96 R
6,082,962 A 7/2000 Drosdziok et al. ..... 415/115
6,162,018 A * 12/2000 Beeck et al. ..... 416/96 R
6,227,799 B1 5/2001 Kuhn et al. ..... 415/115

FOREIGN PATENT DOCUMENTS

| | | |
|---|---|---|
| DE | 854 445 | 8/1952 |
| DE | 196 20 828 | 9/1997 |
| DE | 196 17 539 | 11/1997 |
| DE | 198 52 604 | 5/2000 |
| EP | 0 761 929 | 3/1997 |
| EP | 0 991 850 | 2/2002 |

OTHER PUBLICATIONS

German Search Report for DE 103 55 738.5 and brief translation.

* cited by examiner

*Primary Examiner*—Edward K. Look
*Assistant Examiner*—Dwayne J White
(74) *Attorney, Agent, or Firm*—Darby & Darby

(57) ABSTRACT

A rotor for a steam turbine for working steam and including at least two rotor parts welded to one another using a circumferential, annular weld zone, which is closed in the circumferential direction. A cooling channel system is formed in the rotor and has at least one inlet flow channel, at least one outlet flow channel and at least one cooling channel. In order to simplify the integration of the cooling channel system in the rotor, the weld zone surrounds a cavity which forms a component of the cooling channel system and through which cooling steam flows.

20 Claims, 9 Drawing Sheets

ROTOR FOR A STEAM TURBINE

Priority is claimed to German Patent Application No. DE 103 55 738.5, filed on Nov. 28, 2003, the entire disclosure of which is incorporated by reference herein.

The present invention relates generally to steam turbines and more particularly to a rotor for a steam turbine for working steam and having a cooling channel formed in the rotor.

BACKGROUND

A rotor such as this for a steam turbine is known, for example, from EP 0 991 850 B1, extends along a rotation axis, and comprises at least two rotor parts which are adjacent to one another in the axial direction. In this case, the two rotor parts are welded to one another on mutually facing axial end faces by means of a circumferential, annular weld zone which is closed in the circumferential direction. A cooling channel system is formed in the rotor and has at least one inlet flow channel, at least one outlet flow channel and a cooling channel. The cooling channel carries cooling steam from at least one inlet flow channel to the at least one outlet flow channel. The at least one inlet flow channel taps off the cooling steam from the working steam at a position on the rotor surface, and supplies it to the cooling channel. In contrast to this, the at least one outlet flow channel taps off the cooling steam from the cooling channel and passes this to or through a cooling zone in the rotor. A pressure difference can be formed between the inlet and the outlet of the cooling channel system by suitable positioning of the at least one inlet flow channel and of the at least one outlet flow channel, and this pressure difference is sufficient to pass the cooling steam from the at least one steam tapping point to the at least one cooling zone without any additional measures.

In the case of the known rotor, the cooling channel extends concentrically about the rotation axis. The inlet flow channels are arranged in the area of a diffuser of a single-flow high-pressure turbine, while the outlet flow channels are positioned in the center of a two-flow medium-pressure turbine. The cooling channel in this case extends within the common rotor which is provided for the high-pressure turbine and for the medium-pressure turbine. This rotor is mounted axially between the high-pressure turbine and the medium-pressure turbine. The cooling line accordingly also extends centrally through this bearing. This means that this bearing is subject to an increased temperature load, so that additional measures are required for protection of this bearing.

The known rotor is designed on a so-called "drun principle", that is to say the rotor is formed from a number of "drums". A drum such as this is a cylindrical or truncated conical solid body which, in principle, may contain cavities, such as channels and chambers, for a cooling system. A rotor of a drum design is generally characterized by a small number of drums, which are preferably of different design. In this case, each drum is associated with a number of turbine stages. The end faces of adjacent drums generally rest on one another over their complete area.

DE 196 20 828 C1 discloses an integral rotor which is arranged in a two-flow steam turbine and likewise contains a cooling channel system. A cavity is formed in the center of the hot steam supply on the casing in this rotor and is closed again with the aid of a cover, with the cover at the same time carrying out a flow guidance function. An axial cooling channel originates from each of two axially opposite sides of this cavity. One cooling channel communicates with an inlet flow channel which takes the cooling steam from a pressure stage of one flow. In contrast to this, the other cooling channel communicates with an outlet flow channel, which supplies the cooling steam to a pressure stage of the other flow. The complexity for providing this internal cooling is comparatively high, since, in order to produce the cooling channels, the cavity must first of all be formed on the circumference of the rotor, and must then be closed again. A further disadvantageous feature in this case is that the chosen positioning of the cavity precisely at that point on the rotor which is subject to the highest thermal loads and to high mechanical loads during operation of the steam turbine results in weakening of the structure. Furthermore, additional complexity is required in order to close the cavity again by means of the corresponding cover.

EP 0 761 929 A1 discloses a rotor for a gas turbine, on which a compressor part, a central part and a turbine part are formed and which is composed predominantly of individual rotating bodies which are welded to one another and whose geometric shape leads to the formation of axially symmetrical cavities between the respectively adjacent rotating bodies. In this rotor, a further, cylindrical cavity, which extends about the center axis of the rotor and extends from the downstream end of the rotor to the final upstream cavity, as well as at least two tubes are provided, which have different diameters and different lengths, at least partially overlap telescopically and are arranged in the cylindrical cavity. The tubes are each firmly anchored at a fixing point, with the fixing points for the tubes being located at axially different points. The tubes are each provided with at least two aperture openings in the casing, with at least one opening being arranged in the turbine part and at least one opening being arranged in the compressor or central part. The openings in the various tubes overlap in the operating state in the turbine part, and overlap in the cold state in the compressor and center part. This means that the rotor can be heated up more quickly when the turbine is being started up, while cooling is provided in the operating state. Compressed air is in this case tapped off from a suitable compressor stage for preheating and for cooling, and is supplied axially to one of the tubes.

This known rotor is based on the so-called "disk principle", that is to say the rotor is formed from a number of "disks". The disks correspond to bodies that are in the form of disks and, radially on the outside, have an axially projecting edge area which may be in the form of a sleeve. The edge areas of the adjacent disks rest on one another along relatively small annular surfaces. These disks are therefore the rotating bodies mentioned above. In contrast to a drum, each disk is associated with only a small number of turbine stages, in particular in each case with only a single turbine stage. In a corresponding manner, a rotor based on a disk design comprises a comparatively large number of disks which, furthermore, are preferably physically identical. The cavities which are produced in a rotor based on the disk principle are used predominantly to reduce the inertia forces, but may also be used for a cooling system.

Further rotors for gas turbines which are based on this disk principle can be found, for example, in DE 854 445 B, DE 198 52 604 A1 and DE 196 17 539 A1.

SUMMARY OF THE INVENTION

An object of the present invention is to provide an improved embodiment for a rotor of a steam turbine of the type mentioned initially that allows sufficient cooling of the respective cooling zone of the rotor, in particular of the rotor interior, with reduced production effort.

The present invention provides a rotor whose rotor parts have a depression on each of the end faces in order to produce the welding joint and which together form a cavity which is surrounded by the weld zone in the welded state, the cavity being integrated into the cooling channel system. This measure allows the cavity or the depressions which have been mentioned to be used before the welding of the rotor parts to incorporate the cooling channel or channels and/or the inlet flow channel or channels and/or the outlet flow channel or channels in the respective rotor part. There is therefore no need for any additional recesses, which on the one hand lead to weakening of the material and on the other hand must be closed again. It is thus possible to reduce the effort to provide the rotor-internal cooling channel system. At the same time, the cavity provides a worthwhile double function, thus overall bringing the effort for formation of the welded joint and of the rotor into perspective.

It is particularly important to cool the rotor center in the area in which the rotor has a large external diameter and which is at the same time subject to hot working steam on the outside there. This is frequently the situation in the area of the seal on the thrust balancing piston, through which hot working steam from the turbine inlet flow flows directly, and where the diameter is particularly large at the same time.

The cooling effect of a bore system (cooling channel system) through which cooling steam flows is particularly high if a large number of small bores are used as cooling channels instead of one large bore, because the cooling channel wall on which the cooling steam acts is considerably larger. At the same time, the cross-sectional area of a cooling channel should be small in order to ensure that the cooling steam speed is high, and thus to improve the heat transfer, that is to say the cooling effect. The large number of cooling channels advantageously do not run at the center of the rotor, since a bore through the rotor center considerably weakens the strength of the rotor there. In the case of rotor sections with a large external diameter, the mechanical load at the rotor center is of particular importance owing to the rotor centrifugal force. It frequently represents a physical design limit. Owing to the cooling effect, the solution according to the invention increases the strength at the rotor center, and the physical design limits are shifted in the direction of higher temperatures of the working steam and of a larger rotor diameter.

There are also particular advantages for a rotor which is produced from at least three rotor parts and accordingly has two weld zones as well as two cavities. The two cavities can be connected to one another by means of at least one cooling channel, while the at least one inlet flow channel ends at one cavity and the at least one outlet flow channel starts at the other cavity. With this design, the cavities effectively form nodes, which provide the communication between the at least one cooling channel and the at least one inlet flow channel on the one hand and the at least one outlet flow channel on the other hand. The linking of the at least one inlet flow channel and of the at least one outlet flow channel to one of the cavities in each case also makes it possible to form the at least one cooling channel only in the central rotor part of the three rotor parts, thus reducing the complexity for provision of the cooling channel system.

Further important features and advantages of the invention will become evident from the claims, from the drawings and from the associated description of the figures with reference to the drawings.

BRIEF DESCRIPTION OF THE DRAWINGS

Preferred exemplary embodiments of the invention are illustrated in the drawings and will be explained in more detail in the following description, with the same reference symbols relating to the same, similar or functionally identical components. In the figures, in each case schematically.

DETAILED DESCRIPTION

All of the figures illustrate only the inner housing and the rotor, but not the outer housing.

The invention will be explained in more detail in the following text with reference to exemplary embodiments and to FIGS. 1 to 9.

Figure 1:
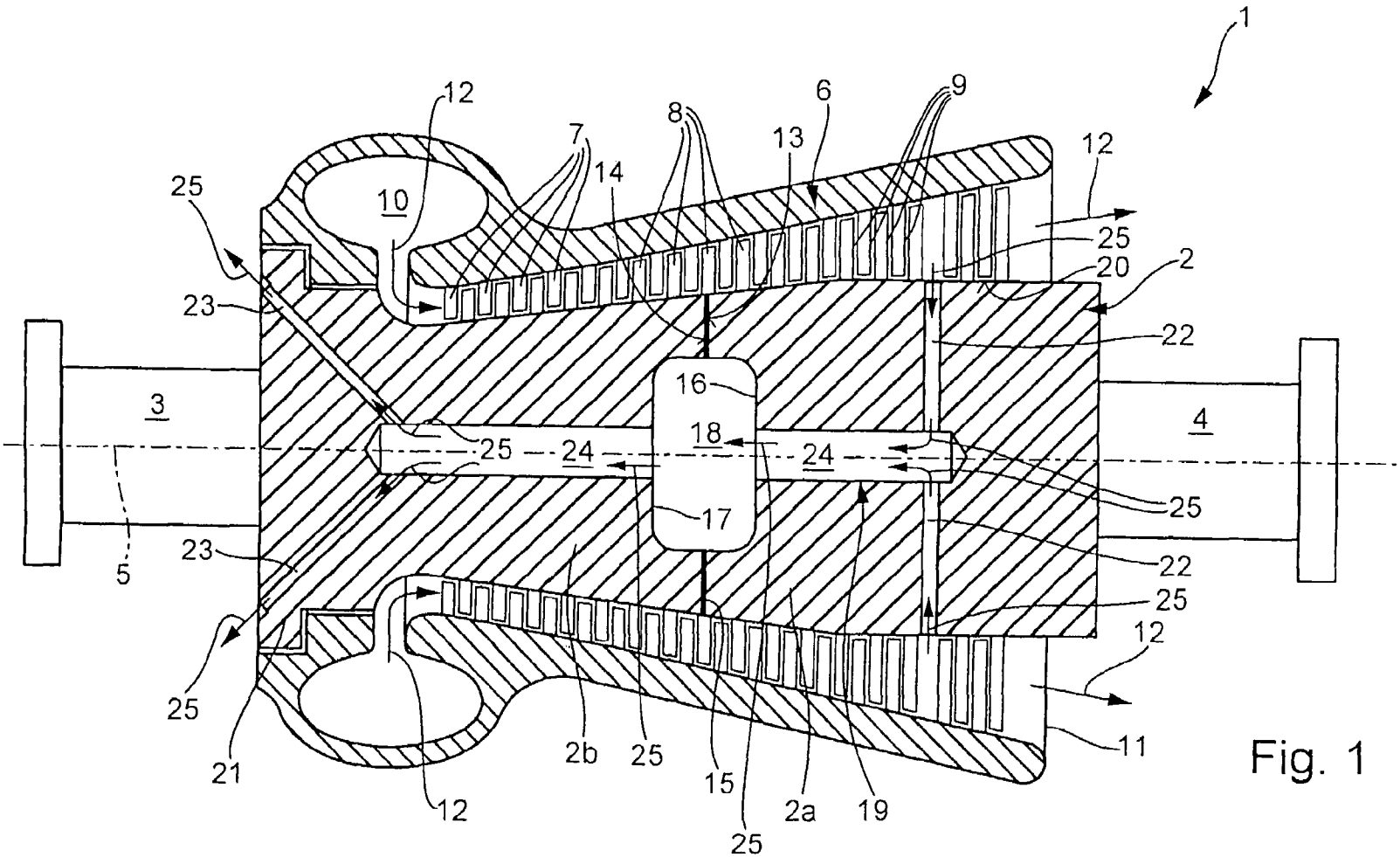
FIGS. 1 to 5 each show different embodiments of a highly simplified longitudinal section through a single-flow steam turbine with a two-part welded drum rotor according to the invention.

As is shown in FIG. 1, a steam turbine 1 has a rotor 2 which is mounted at its axial ends 3 and 4 such that it can rotate about a central rotation axis 5. The rotor 2 is arranged centrally in a housing 6, to which a number of stator blades 7 are fitted. Corresponding to this, the rotor 2 is fitted with a number of rotor blades 8, with the rotor blades 8 and the stator blades 7 forming, in pairs, the turbine stages 9 of the steam turbine 1. As is known, a steam turbine 1 operates with steam as the working medium, and this is also referred to as working steam. The housing 6 contains an inlet flow area 10, to which the compressed steam is supplied and from which the steam is passed to the first turbine stage 9 of the steam turbine 1. The expanded steam is carried away from an outlet 11 of the housing 6. Arrows 12 in this case symbolize the main flow of the steam through the steam turbine 1.

The rotor 2 is formed from a number of parts and, in the embodiments shown in FIGS. 1 to 5, in each case has two rotor parts 2*a* and 2*b*, which are adjacent to one another in the axial direction. The rotor 2 is in this case in the form of a "drum rotor" 2, that is to say the rotor 2 is designed on the drum principle. The individual rotor parts 2*a*, 2*b* in this case form the "drums" of the drum rotor 2, and are characterized by their solid structure, with a large material thickness in the radial and axial directions.

The two rotor parts 2*a*, 2*b* are welded to one another. For this purpose, a weld zone 15 is formed on mutually facing axial end faces 13 and 14 of the rotor parts 2*a*, 2*b*, extends in the circumferential direction and at the same time is closed circumferentially. This results in the weld zone 15 having an annular shape.

In order to form this weld zone 15, the two rotor parts 2*a*, 2*b* are provided with a depression 16 or 17, respectively, of any desired shape on their respective end faces 13, 14. In the assembled state, the two depressions 16, 17 complement one another to form a cavity 18. This cavity 18 is thus circumferentially surrounded by the weld zone 15.

The rotor 2 is also equipped with an internal cooling channel system 19, which allows partially expanded and thus partially cooled-down steam to be tapped off at a position on the rotor surface 20, and for this steam to be supplied as cooling steam at least to a thermally loaded component of the rotor 2, such as a thrust balancing piston 21. The cooling steam is accordingly the same medium as the working steam. For this purpose, the cooling channel system 19 has at least one inlet flow channel 22 for tapping off the cooling steam from the working steam at a position on the rotor surface 20 on a turbine stage 9 which is suitable for this purpose. In the present case, two such inlet flow channels 22 are shown. It is obvious that more than two inlet flow channels 22 may also be provided and, in particular, may be arranged in a star shape with respect to the rotation axis 5. Furthermore, at least one outlet flow channel 23 is provided, which carries the cooling steam through at least one cooling zone, in this case by way of example the thrust balancing piston 21 and/or to a cooling zone of the rotor 2 or of a rotor or turbine component. Two outlet flow channels 23 are likewise illustrated in the present case. However, more than two outlet flow channels 23 may also be provided, and may be arranged in particular in a star shape with respect to the rotation axis 5.

Furthermore, the cooling channel system 19 has at least one cooling channel 24 which, together or in each case on their own, connects or connect the at least one inlet flow channel 22 to the at least one outlet flow channel 23. In this way, the cooling steam is tapped off from the respective turbine stage 9 as shown by the arrows 25 via the at least one inlet flow channel 22, and is supplied via the cooling channel or channels 24 to the at least one outlet flow channel 23, which itself supplies the cooling steam to the respective cooling zone, for example to the thrust balancing piston 21. The chosen positioning of the inlet flow ends of the inlet flow channels 22 and of the outlet flow ends of the outlet flow channels 23 results in a pressure gradient within the cooling channel system 19, which automatically transports the cooling steam in the desired manner within the cooling channel system 19.

According to the invention, the cavity 18 is now integrated in the cooling channel system 19. In the embodiment shown in FIG. 1, this is done by connecting each of the cooling channels 24 to this cavity 18. The cooling channel 24 illustrated on the right is connected on the input side to the inlet flow channels 22, and on the output side to the cavity 18. The cooling channel 24 shown on the left is connected on the input side to the cavity 18 and on the output side to the outlet flow channels 23. This results in the cavity 18 becoming a component of the cooling channel system 19 through which cooling steam flows. The cavity 18 in this case forms a type of distribution node, which distributes the cooling steam (which is supplied via one or more channels 22 or 24) to one or more channels 23, 24.

In the embodiment shown in FIG. 1, the two cooling channels 24 are each formed concentrically about the rotation axis 5 in the respective rotor part 2*a*, 2*b*. The design of these cooling channels 24 is in this case particularly simple, since the rotor parts 2*a*, 2*b* can be drilled centrally in the area of their depressions 16, 17 before being welded, in order to form these cooling channels 24. There is no need for any additional depression, incorporated for assistance purposes, in the surface of the respective rotor part 2*a*, 2*b*. The inlet flow channels 22, which in this case extend essentially radially, may be produced in the form of bores. This also applies in a corresponding manner to the outlet flow channels 23, which in this case extend diagonally/concentrically. With respect to the flow direction within the cooling channel system 19, the cooling channel 24 illustrated on the right ends at the cavity 18, while the cooling channel 24 illustrated on the left starts at the cavity 18.

Figure 2:
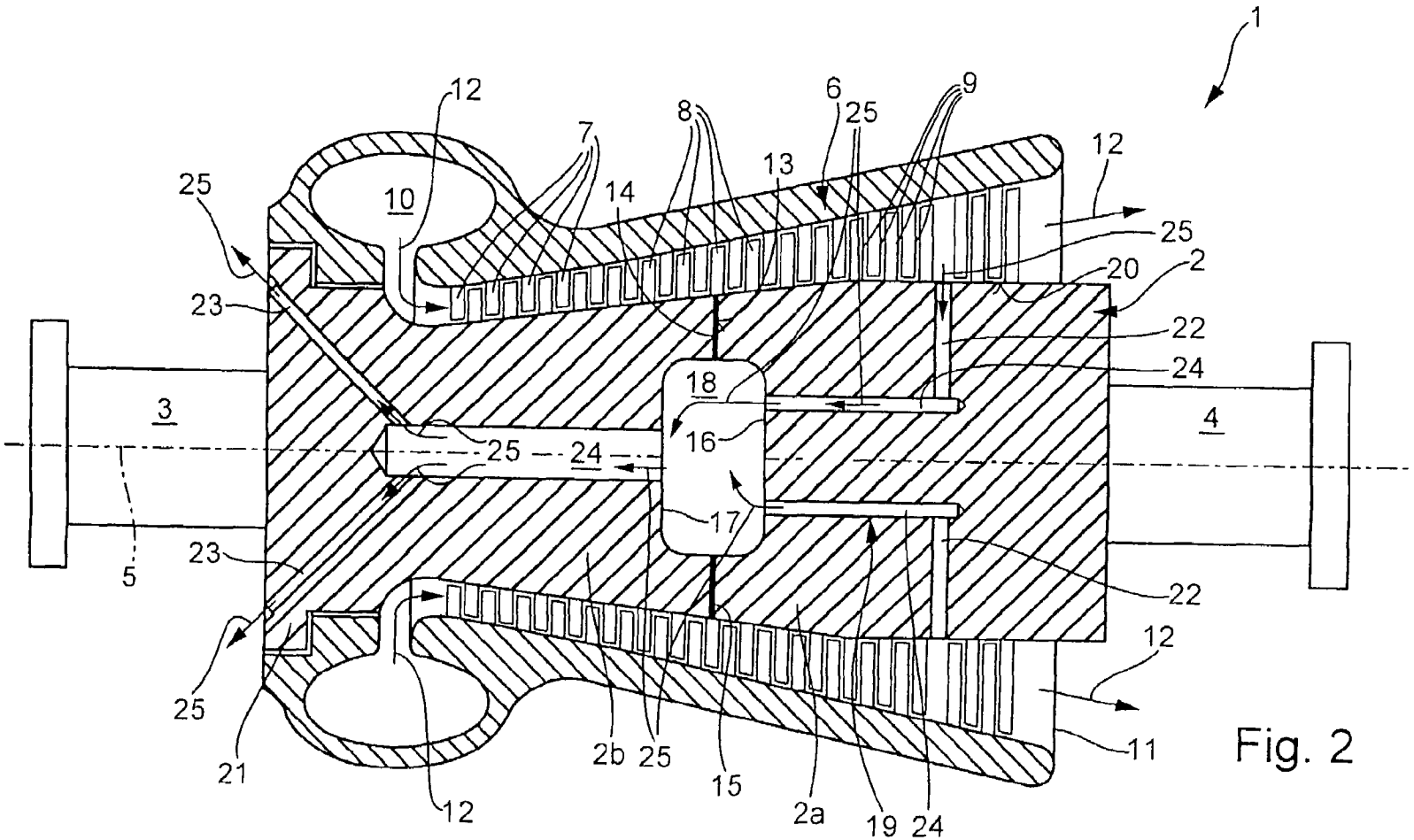

The embodiment shown in FIG. 2 differs from the embodiment shown in FIG. 1 in that no central cooling channel 24 is provided in the rotor part 2*a* illustrated on the right and, instead, a number of cooling channels 24 are provided which are arranged off-center or eccentrically with respect to the rotation axis 5, but run parallel to the longitudinal axis and each communicate with one of the inlet flow channels 22. This configuration avoids the incorporation of a central cooling channel 24, which may be advantageous for certain rotor designs. The number of cooling channels 24 formed in the right-hand rotor part 2*a* then corresponds to the number of inlet flow channels 22 provided there.

In a further embodiment, which is not illustrated, it is also possible for a number of inlet flow channels 22, arranged like a fan, to meet on one cooling channel 24.

Figure 3:
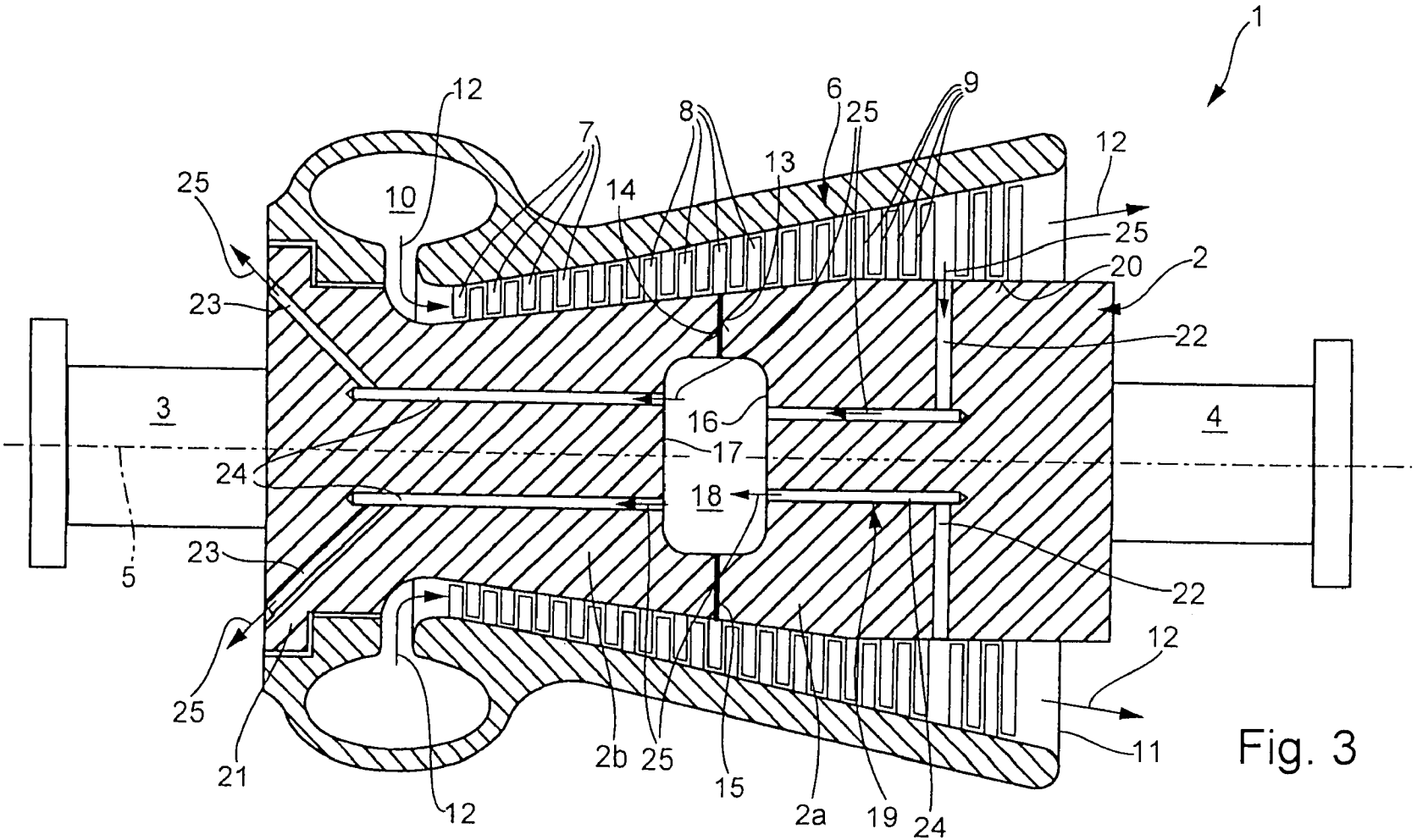

The embodiment shown in FIG. 3 differs from the embodiment shown in FIG. 2 in that two or more cooling channels 24, which are arranged off-center or eccentrically with respect to the rotation axis 5, are also provided in the rotor part 2*b* illustrated on the left, instead of one central cooling channel 24. These cooling channels 24 also preferably extend parallel to the longitudinal axis of the rotor 2, and each communicate with one of the outlet flow channels 23. The number of cooling channels 24 in the rotor part 2*b* illustrated on the left then corresponds to the number of outlet flow channels 23 incorporated there, although this need not necessarily be the case. For certain embodiments of the rotor 2, it may also be advantageous to incorporate a number of cooling channels 24 which are off-center or eccentric with respect to a central cooling channel 24 in the left-hand rotor part 2*b*.

As soon as a number of cooling channels 24 run eccentrically and parallel to one another, as is the case, by way of example, in the embodiments shown in FIGS. 2 and 3, they are expediently arranged with a symmetrical distribution in the respective rotor part 2*a*, 2*b*, that is to say the respective cooling channels 24 are arranged concentrically about the rotation axis 5.

In the embodiments shown in FIGS. 1 to 3, the cavity 18 is effectively arranged between the successive cooling channels 24 in the axial direction. The inlet flow channels 22 and the outlet flow channels 23 can communicate with the cavity 18 only via the cooling channels 24. In contrast to this, in the case of the embodiment shown in FIG. 4, the split in the rotor 2 is adapted to the position of the outlet flow channels 23, that is to say the weld zone 15 is shifted in the direction of the respective cooling zone in comparison to the embodiments shown in FIGS. 1 to 3, that is to say in this case in the direction of the thrust balancing piston 21. This configuration makes it possible to connect the outlet flow channels 23 directly to the cavity 18. In this embodiment, the outlet flow channels 23 accordingly start at the cavity 18. This results in the production of the cooling channel system 19 being simplified considerably, since there is no need to form a cooling channel 24 in the left-hand rotor part 2*b*. In the right-hand rotor part 2*a*, the cooling channel system 19 is formed as in the embodiment shown in FIG. 1 by providing a central cooling channel 24 which communicates with the inlet flow channels 22.

Figure 4:
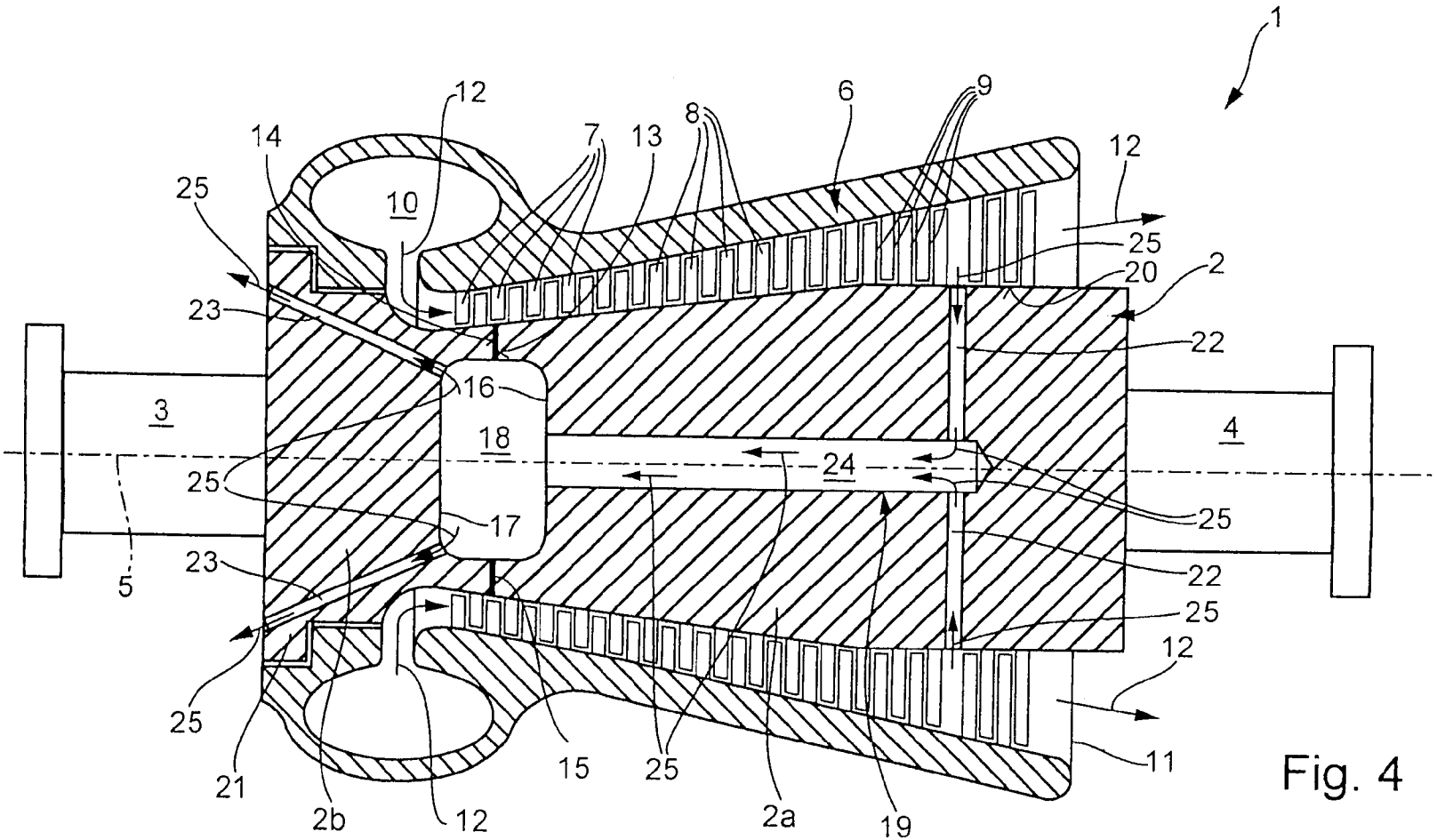
Figure 5:
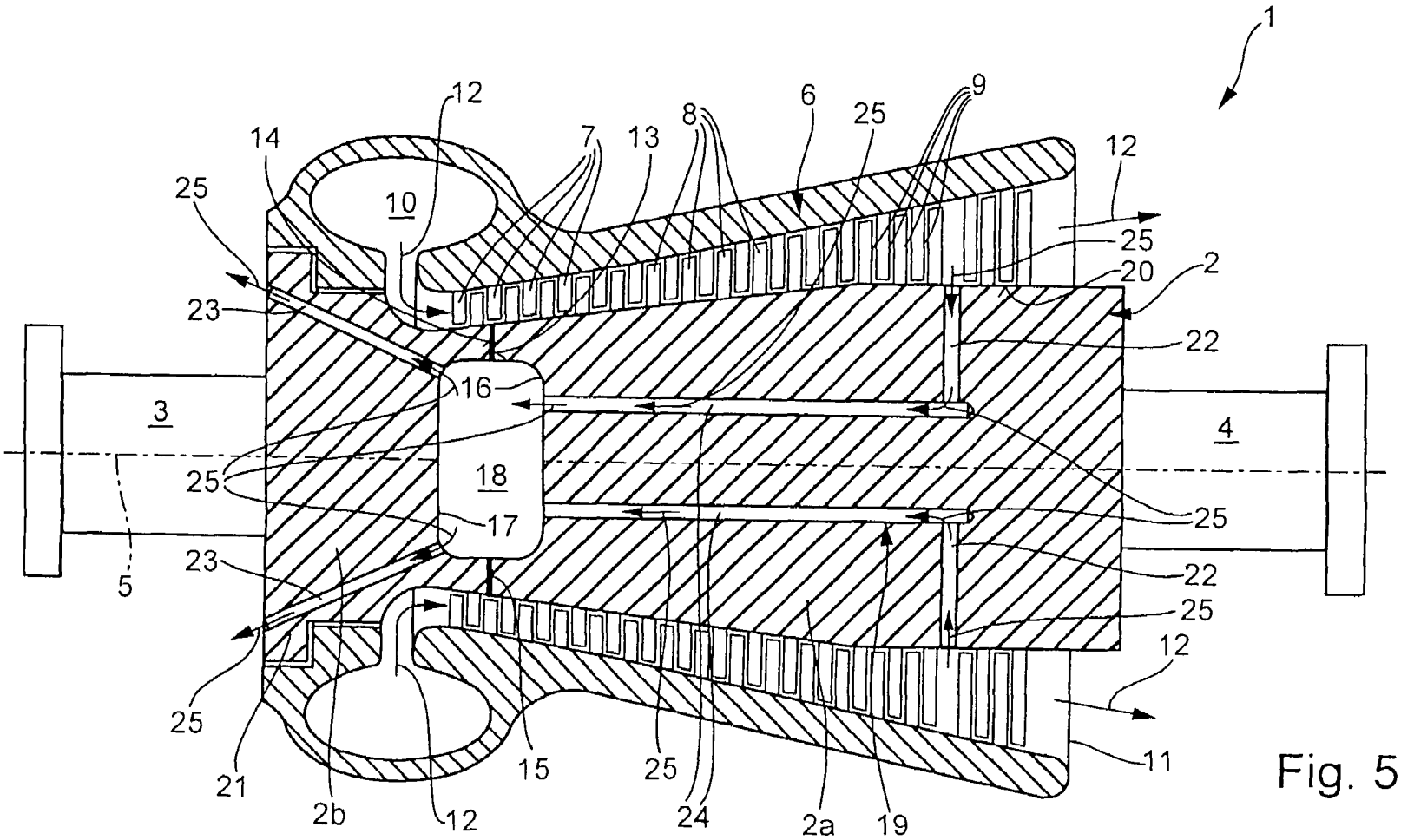
Figure 6:
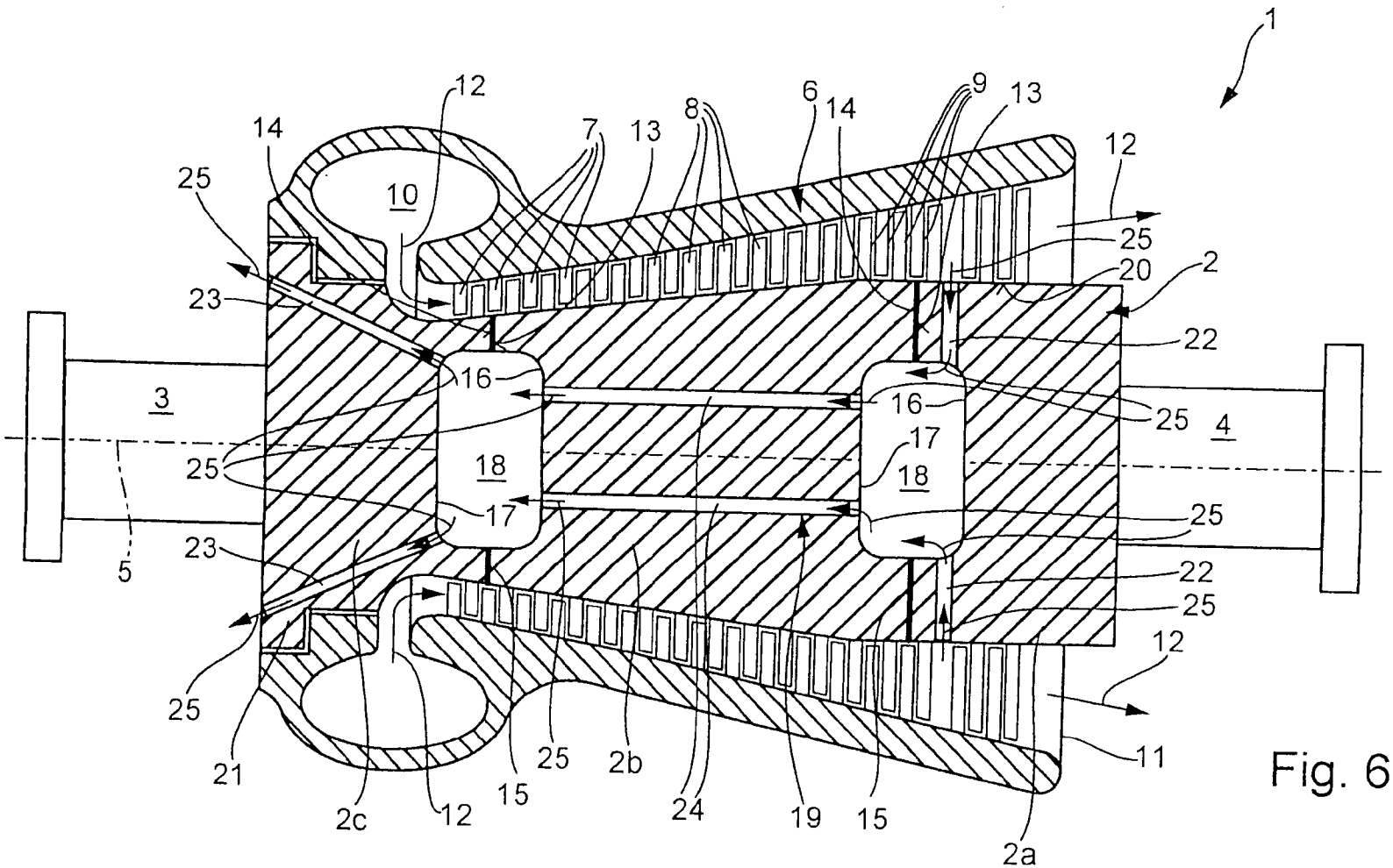
FIG. 6 shows a highly simplified longitudinal section through a single-flow steam turbine with a three-part welded drum rotor according to the invention, FIGS. 7 to 9 each show different embodiments of a highly simplified longitudinal section through a two-flow steam turbine with a three-part welded drum rotor according to the invention.

The embodiment shown in FIG. 5 differs from the embodiment shown in FIG. 4 in that a number of cooling channels 24, which are arranged off-center or eccentrically with respect to the rotation axis 5 and which each communicate with one of the inlet flow channels 22, are provided instead of the central cooling channel 24 in the right-hand rotor part 2*a*. This may be advantageous for certain embodiments of the rotor 2.

In the embodiments shown in FIGS. 4 and 5, the outlet flow channels 23 are connected directly to the cavity 18, while the inlet flow channels 22 are connected indirectly to the cavity 18, via the cooling channels 24. A different embodiment is in principle also possible, in which the split in the rotor 2 is chosen such that the inlet flow channels 22 can be connected directly to the cavity 18, while the outlet flow channels 23 can then be connected indirectly to the cavity 18 via one or more cooling channels 24. The weld zone 15 is then shifted in the direction of the tapping point for the cooling steam.

In another embodiment, the at least one cooling channel 24 may be formed by the cavity 18, which means that both the inlet flow channels 22 and the outlet flow channels 23 are connected directly to the cavity 18.

The embodiments shown in FIGS. 1 to 5 have the common feature that the at least one tapping point, in this case the respective turbine stage 9, is arranged at a position on the rotor surface 20 in the area of one rotor part 2*a*, while the at least one cooling zone, in this case the thrust balancing piston 21, is arranged in the area of the other rotor part 2*b*. This means that, with these embodiments, the at least one inlet flow channel 22 is necessarily arranged in one rotor part 2*a*, while the at least one outlet flow channel 23 is arranged in the other rotor part 2*b*. The cooling channel system 19 thus extends through both rotor parts 2*a* and 2*b* within the two-part rotor 2.

While the rotor 2 is in two parts in the embodiments shown in FIGS. 1 to 5, FIG. 6 shows an embodiment with a three-part rotor 2, with the individual rotor parts being annotated 2*a*, 2*b* and 2*c* from right to left. This rotor 2 is also in the form of a drum rotor 2. Since it is in three parts, two weld zones 15 and thus also two cavities 18 are accordingly provided. In this case, both cavities 18 are integrated in the cooling channel system 19 in the sense of the invention. The split in the rotor 2 is in this case deliberately chosen such that the inlet flow channels 22 communicate directly with one cavity 18, while the outlet flow channels 23 communicate directly with the other cavity 18. The two cavities 18 are then connected to one another via the at least one cooling channel 24, in this case via at least two cooling channels 24. This deliberate split in the rotor 2 simplifies the integration of the cooling channel system 19 in the rotor 2. This is because single bores can be provided both for the formation of the inlet flow channels 22 and for the formation of the outlet flow channels 23, leading from the respective tapping point or from the respective cooling zone to the respective cavity 18. Furthermore, the cooling channel or channels 24 can also be produced by single bores. In the embodiment shown in FIG. 6, only the inlet flow channels 22 are accordingly formed in the rotor part 2*a* illustrated on the right, only the outlet flow channels 23 are formed in the rotor part 2*c* illustrated on the left, while the central rotor part 2*b* contains only the cooling channel or channels 24.

Two or more cooling channels 24 are arranged eccentrically in the central rotor part 2*b* of the rotor 2. An embodiment is likewise possible in which a central cooling channel 24 extends between the two cavities 18. Furthermore, in principle, an embodiment is also possible in which at least one of the weld zones 15 is positioned such that the associated outer rotor part 2*a* or 2*c* contains neither an inlet flow channel 22 nor an outlet flow channel 23. For example, the weld zone 15 shown on the right can be positioned on the right alongside the cooling steam tapping point, which means that the inlet flow channels 22 must then be formed in the central rotor part 2*b*. This configuration means that the right-hand rotor part 2*a* then does not contain any inlet flow channel 22. This has the advantage that the right-rotor part 2*a* need not be machined at all in order to form the rotor-internal cooling channel system 19. A corresponding situation then also applies to the weld zone 15 shown on the left with respect to the outlet flow channels 23.

Figure 7:
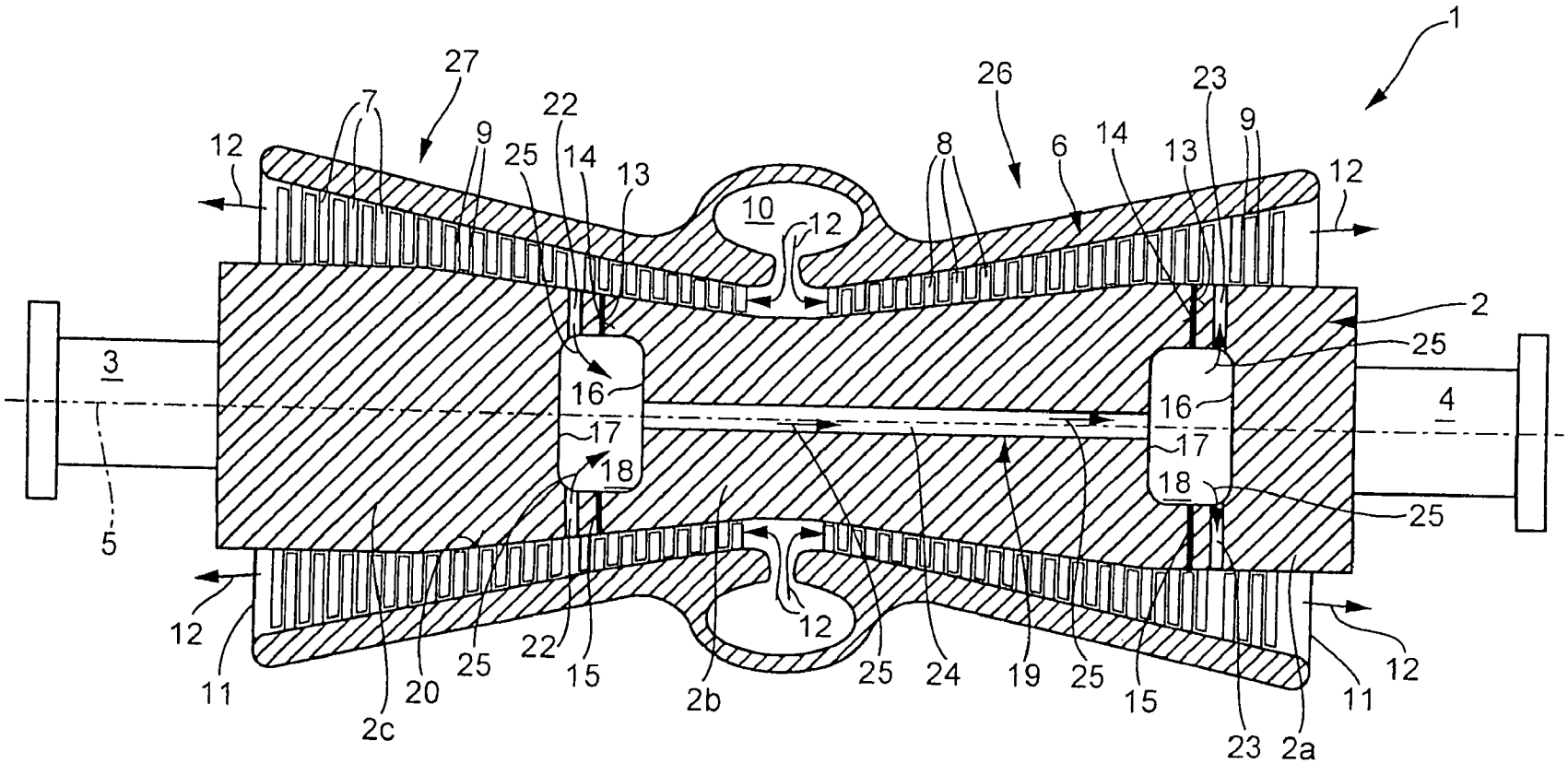
Figure 8:
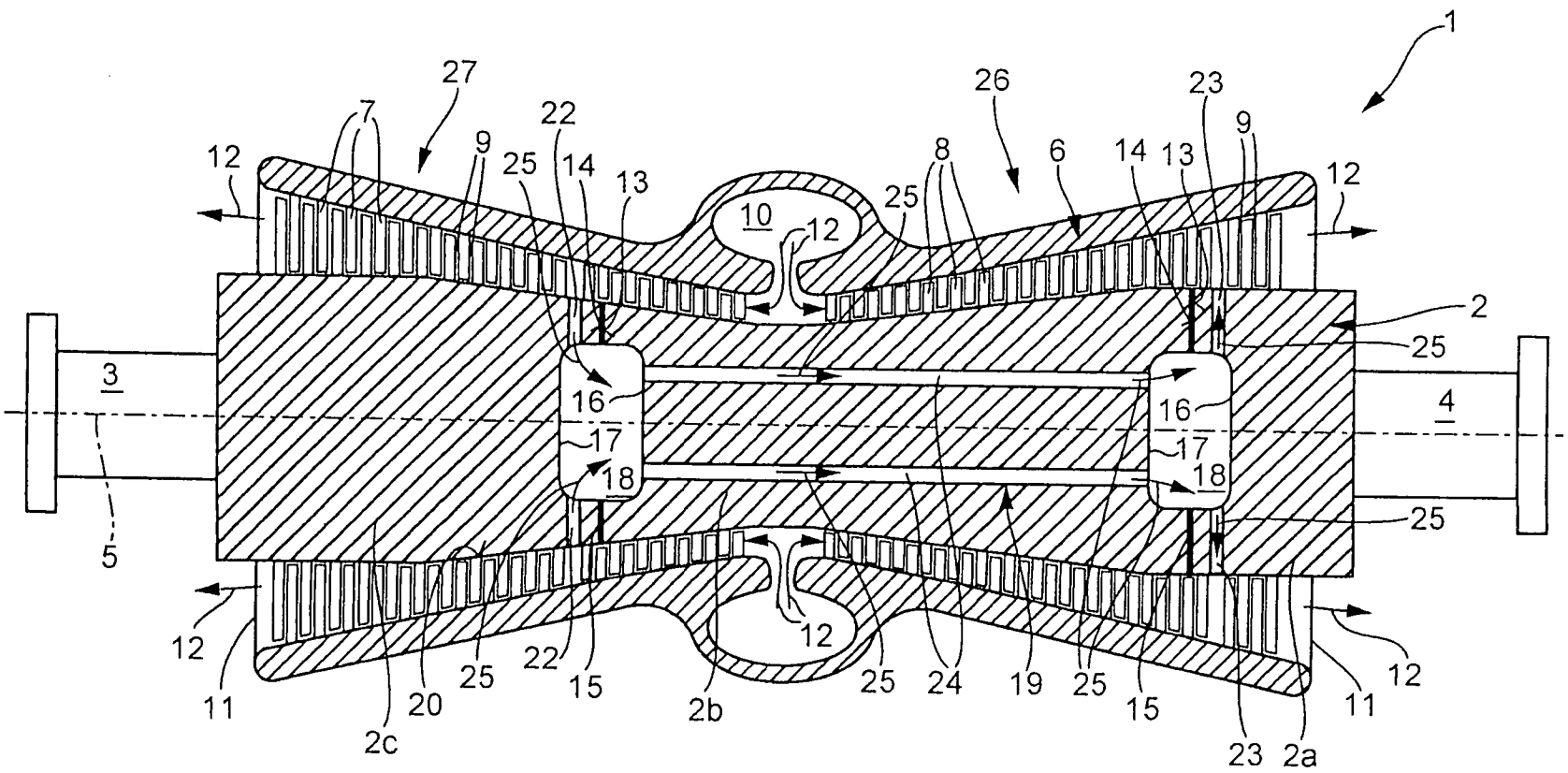
Figure 9:
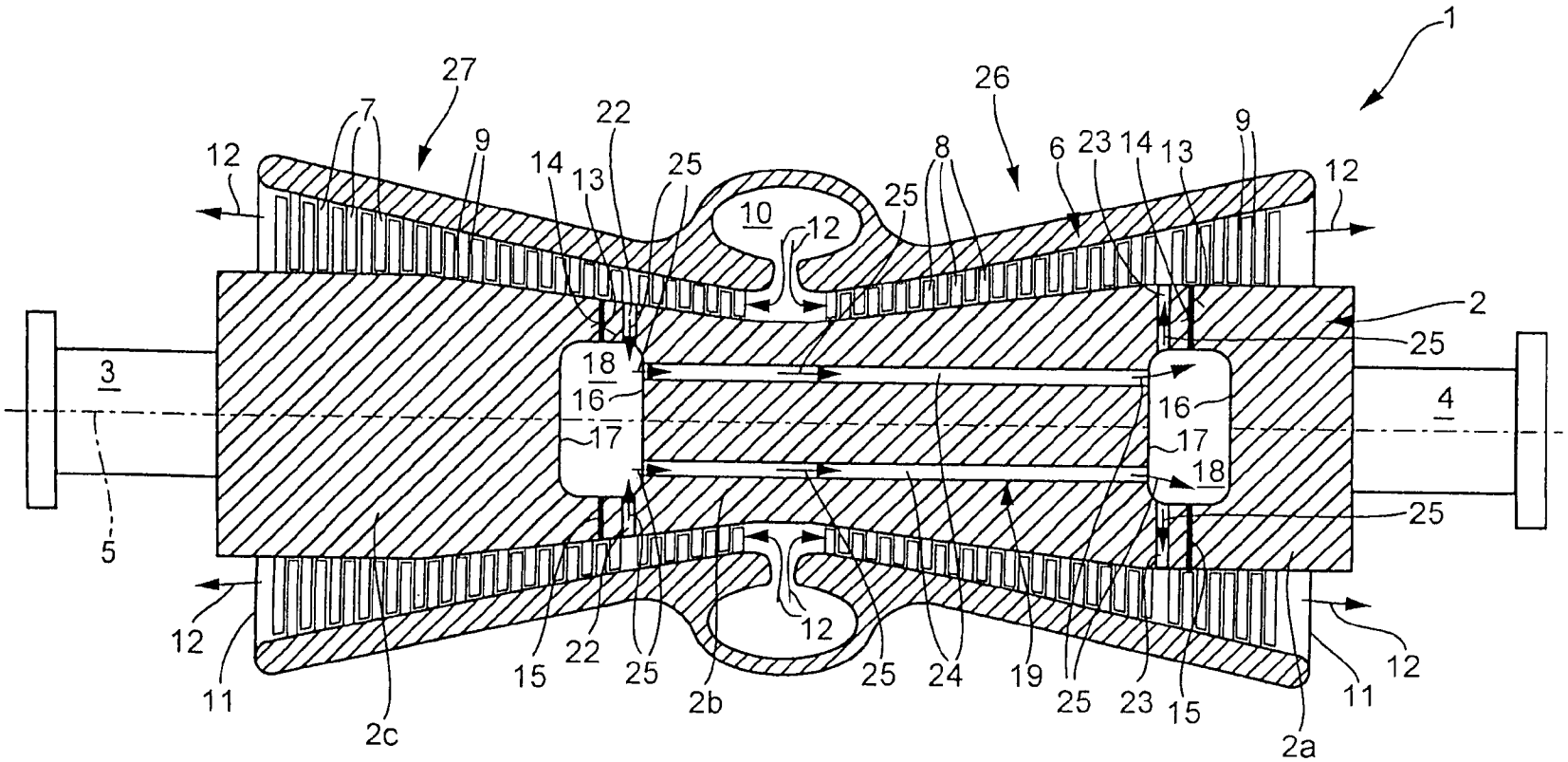

While the steam turbine 1 in the embodiments shown in FIGS. 1 to 6 is a single-flow machine, FIGS. 7 to 9 show two-flow steam turbines 1. The two flows are in this case annotated 26 and 27. In this two-flow steam turbine 1, the rotor 2 is once again in three parts and is in the form of a drum rotor 2, with the central rotor part 2*b* extending into both flows 26, 27. The rotor 2 is deliberately split such that the weld zones 15 with their cavities 18 are in each case positioned such that the inlet flow channels 22 can be connected directly to one cavity 18, in this case the left-hand cavity 18, while the outlet flow channels 23 can be connected directly to the other cavity 18, in this case the right-hand cavity 18. The two cavities 18 then communicate with one another via the at least one cooling channel 24. Cooling steam can thus be tapped off from the flow 27 illustrated on the left in a specific turbine stage 9 with the aid of the cooling channel system 19, and can be supplied to the blade system for the other flow 26, which is illustrated on the right. Suitable positioning of the at least one tapping point and of the at least one return line point results in a sufficient pressure gradient within the cooling channel system 19 in order to make it possible to drive the cooling steam without any additional measures.

In this embodiment as well, it is clear that the integration of the cavities 18 in the cooling channel system 19 results in the complexity for provision of the cooling channel system 19 being relatively low, since the depressions 16, 17 in the end faces 13, 14 of the rotor parts 2*a*, 2*b*, 2*c* considerably simplify the incorporation of the inlet flow channels 22 and of the outlet flow channels 23, as well as the cooling channels 24.

In the embodiment shown in FIG. 7, the two cavities 18 are connected to one another by means of a centrally arranged cooling channel 24. In contrast to this, in the embodiment shown in FIG. 8, the two cavities 18 are connected to one another by means of two or more cooling channels 24 which are arranged eccentrically with respect to the rotation axis 5. These cooling channels 24 are expediently arranged such that they are distributed concentrically about the rotation axis 5. In this case, the number of cooling channels 24 need not match either the number of inlet flow channels 22 or the number of outlet flow channels 23.

In the embodiments shown in FIGS. 7 and 8, the inlet flow channels 22 are formed in the rotor part 2*c* illustrated on the left, the outlet flow channels 23 are formed in the rotor part 2*a* shown on the right, and the cooling channel or channels 24 is or are formed in the central rotor part 2*b*. In principle, it is possible to incorporate the axial split in the rotor 2 deliberately such that the inlet flow channels 22 and/or the outlet flow channels 23 are likewise arranged in the central rotor part 2*b*. FIG. 9 shows one preferred embodiment, in which both the inlet flow channels 22 and the outlet flow channels 23 are arranged in the central rotor part 2*b*, in which the cooling channel or channels 24 is or are also formed. Thus, with this configuration, only the central rotor part 2*b* need be machined in order to form the cooling channel system 19 throughout the entire rotor 2. In consequence, the complexity for provision of the cooling channel system 19 is reduced.

The invention is, of course, not restricted to the described exemplary embodiments. Although it can be used particularly well for the rotor of steam turbines, in which hot steam is used as the working medium and cooling steam is used as the cooling medium, it can, of course, likewise be used for the rotor of an air turbine.

What is claimed is:

1. A rotor for a steam turbine for working steam extending along an axis of rotation, the rotor comprising:

a first rotor part having a first axial end face and a first depression formed in the first axial end face;

a second rotor part having a second axial end face and a second depression formed in the second axial end face, the second rotor part disposed axially adjacent to the first rotor part so that the second axial end face faces the first axial end face, and welded to the first rotor part along the first and second axial end faces so that the first and second depressions form a cavity;

an annular weld zone circumferentially surrounding the cavity and being closed in a circumferential direction;

a cooling channel system formed in the rotor and including the cavity, the cooling channel system further including at least one inlet flow channel configured to receive cooling steam from the working steam at a region of an outer surface of the rotor, at least one outlet flow channel configured to pass the cooling steam to at least one cooling zone of the rotor, and at least one cooling channel disposed between the at least one inlet flow channel and the at least one outlet flow channel, the cooling steam flowing through the at least one cooling channel and the cavity.

2. The rotor as recited in claim 1, wherein the outlet flow channel passes the cooling steam through the at least one cooling zone.

3. The rotor as recited in claim 1, wherein the at least one cooling channel includes a first cooling channel that communicates with the at least one inlet flow channel and ends at the cavity and a second cooling channel that communicates with the at least one outlet flow channel and stains at the cavity.

4. The rotor as recited in claim 1, wherein the at least one cooling channel communicates with the at least one inlet flow channel and ends at the cavity, and wherein the at least one outlet flow channel starts at the cavity.

5. The rotor as recited in claim 1, wherein the at least one cooling channel communicates with the at least one outlet flow channel and starts at the cavity, and wherein the at least one inlet flow channel ends at the cavity.

6. The rotor as recited in claim 1, wherein the cooling channel is formed by the cavity, the at least one inlet flow channel ends at the cavity, and the at least one outlet flow channel starts at the cavity.

7. The rotor as recited in claim 1, wherein the at least one inlet flow channel extends in the first rotor part and the at least one outlet flow channel extends in the second rotor part.

8. The rotor as recited claimed in claim 1, wherein the second rotor part includes a further axial end face defining a further depression, the rotor further comprising:

a third rotor part having a third axial end face and a third depression, the third rotor part disposed adjacent to the second rotor part so that the third axial end face faces toward the further axial end face, and welded to the second rotor part along the further and third axial end faces so as to form a further cavity; and a further weld zone circumferentially surrounding the further cavity, wherein the at least one cooling channel connects the cavity to the further cavity, wherein the at least one inlet flow channel ends at the cavity and the at least one outlet flow channel starts at the further cavity.

9. The rotor as recited in claim 8, wherein the at least one inlet flow channel extends in at least one of the first rotor part and the second rotor part, and wherein the at least one outlet flow channel extends in at least one of the third rotor part and the second rotor part.

10. The rotor as recited in claim 1, wherein the steam turbine is a single-flow machine and the at least one cooling zone includes a thrust balancing piston of the rotor.

11. The rotor as recited in claim 1, wherein the steam turbine is a two-flow machine having first and second flows of the steam and a plurality of turbine stages, and wherein the cooling steam is received in the at least one inlet flow channel at a first turbine stage from the first flow and wherein the at least one cooling zone includes at least a second turbine stage for the second flow.

12. The rotor as recited in claim 1, wherein the at least one cooling channel extends concentrically about the rotation axis.

13. The rotor as recited in claim 1, wherein the at least one cooling channel extends eccentrically with respect to the rotation axis and essentially parallel to the rotation axis.

14. The rotor as recited in claim 1, wherein the at least one inlet flow channel meets the cooling channel and extends in a direction with respect to the rotation axis that is one of an essentially radial direction, a diagonally concentric direction and a diagonally eccentric direction.

15. The rotor as recited in claim 14, wherein the at least one outlet flow channel meets the cooling channel and extends in a direction with respect to the rotation axis that is one of an essentially radial direction, a diagonally concentric direction and a diagonally eccentric direction.

16. The rotor as claimed claim 1, wherein the rotor is a drum rotor including a plurality of drums formed by the rotor parts.

17. A rotor for a steam turbine for working steam extending along axis of rotation, the rotor comprising:

a first rotor part having a first axial end face defining a first depression;

a second rotor part having a second axial end face defining a second depression, the second rotor part disposed adjacent to the first rotor part so that the second axial end face faces the first axial end face and the first and second depressions form a cavity;

an annular weld zone at the first and second axial end faces circumferentially surrounding the cavity;

a cooling channel system formed in the rotor and including the cavity, at least one inlet flow channel configured to receive cooling steam from the working steam at a region of an outer surface of the rotor and at least one outlet flow channel configured to pass the cooling steam to at least one cooling zone of the rotor, the cavity being disposed between the at least one inlet flow channel and the at least one outlet flow channel.

18. The rotor as recited in claim 17, wherein the cooling channel system further includes at least one cooling channel communicating with the at least one inlet flow channel, the at least one outlet flow channel, and the cavity.

19. The rotor as recited in claim 18, wherein the at least one cooling channel is disposed between the cavity and one of the at least one inlet flow channel and the at least one outlet flow channel.

20. The rotor as recited in claim 18, wherein the at least one cooling channel includes a first cooling channel disposed between the at least one inlet flow channel and the cavity and a second cooling channel disposed between the cavity and the at least one outlet flow channel.

* * * * *